US005727759A

United States Patent [19]

Christensen

[11] Patent Number: 5,727,759

[45] Date of Patent: Mar. 17, 1998

[54] INTEGRATED MOUSE PAD AND WRIST AND ARM SUPPORT

[76] Inventor: Leslie Palmatier Christensen, 6864 B Brindle Heath Way, Alexandria, Va. 22315

[21] Appl. No.: 521,657

[22] Filed: Aug. 31, 1995

[51] Int. Cl.[6] ..... B43L 5/00

[52] U.S. Cl. ..... 248/118; 248/118.3; 248/289.11; 248/918; 297/411.23; 297/411.36

[58] Field of Search ..... 248/118, 118.1, 248/118.3, 118.5, 918, 289.11; 297/411.23, 411.35, 411.36, 188.2, 188.21

[56] References Cited

U.S. PATENT DOCUMENTS

| | | | |
|---|---|---|---|
| 1,007,590 | 10/1911 | Miller | 248/289.11 |
| 2,477,898 | 8/1949 | Rehman et al. | 248/118 |
| 2,659,423 | 11/1953 | Haley | 297/411.36 X |
| 4,576,351 | 3/1986 | Brink | 248/118 |
| 4,822,103 | 4/1989 | Stenvall | 297/411.35 |
| 4,913,393 | 4/1990 | Wood | 297/411.23 X |
| 4,961,610 | 10/1990 | Reeder et al. | 297/411.35 |
| 5,407,249 | 4/1995 | Bonutti | 297/411.35 |
| 5,641,203 | 6/1997 | Van De Riet et al. | 297/411.36 X |

*Primary Examiner*—Derek J. Berger

[57] ABSTRACT

An integrated mouse pad and wrist and arm support which can be attached to an armless desk chair and which provides support for both the wrist and arm of a computer operator. The device provides a support arm with a mouse pad at one end and enables the user's wrist and arm to rest at the same level as the mouse pad. Use of the device reduces stress to the wrist and arm during use of a mouse. The device is detachably attached to a support column which supports the seat of the chair, and the height of the device can be adjusted as desired by the operator. The angular position of the device with respect to the operator can be adjusted to a selected ergonomic position.

1 Claim, 3 Drawing Sheets

INTEGRATED MOUSE PAD AND WRIST AND ARM SUPPORT

BACKGROUND OF THE INVENTION

1. Field of the Invention

This invention relates to a mouse pad having a support member which is integral with the mouse pad and which extends from the mouse pad to provide support for the user's wrist and arm. The integrated mouse pad and support member is configured so as to be attachable to a chair in which the user sits when using the mouse pad while operating a computer.

2. Description of the Prior Art

There is growing concern about the need for comfortable positioning of the wrist and arm of a user of a keyboard for inputting text and data to a computer. Operators of the computer also use a mouse to input commands to the computer. Manipulation of the mouse requires the use of both wrist and arm movements. The mouse is placed on a mouse pad which is positioned near the keyboard and the user must often perform many mouse operations during a given day of using the computer, each operation requiring that the mouse be grasped, moved, and clicked. These operations currently must be performed without adequate support for the wrist and arm of the user, resulting in muscle and tendon strain which can lead to discomfort or even permanent injury.

SUMMARY OF THE INVENTION

In order to provide support for the wrist and arm of the user of the mouse, a mouse pad having an integrated support member is provided. The support member and the mouse pad are constructed as one piece with the support member extending from the mouse pad toward the user permitting the user to rest the wrist and forearm on the support member. The mouse pad with integrated support member is attachable to the center column of a chair using an attaching member, the height of which can be adjusted. The angular position of the mouse pad and integrated support member relative to the user can be adjusted to a selected ergonomic position and locked in place by means of a positioning platform and associated positioning pin, threaded positioning holes, and a threaded locking bolt.

DETAILED DESCRIPTION OF THE INVENTION

The detailed description will hereunder be given of the preferred embodiment of the integrated mouse pad and wrist and arm support with positioning and attaching assemblies with reference to the accompanying drawings.

Figure 1:
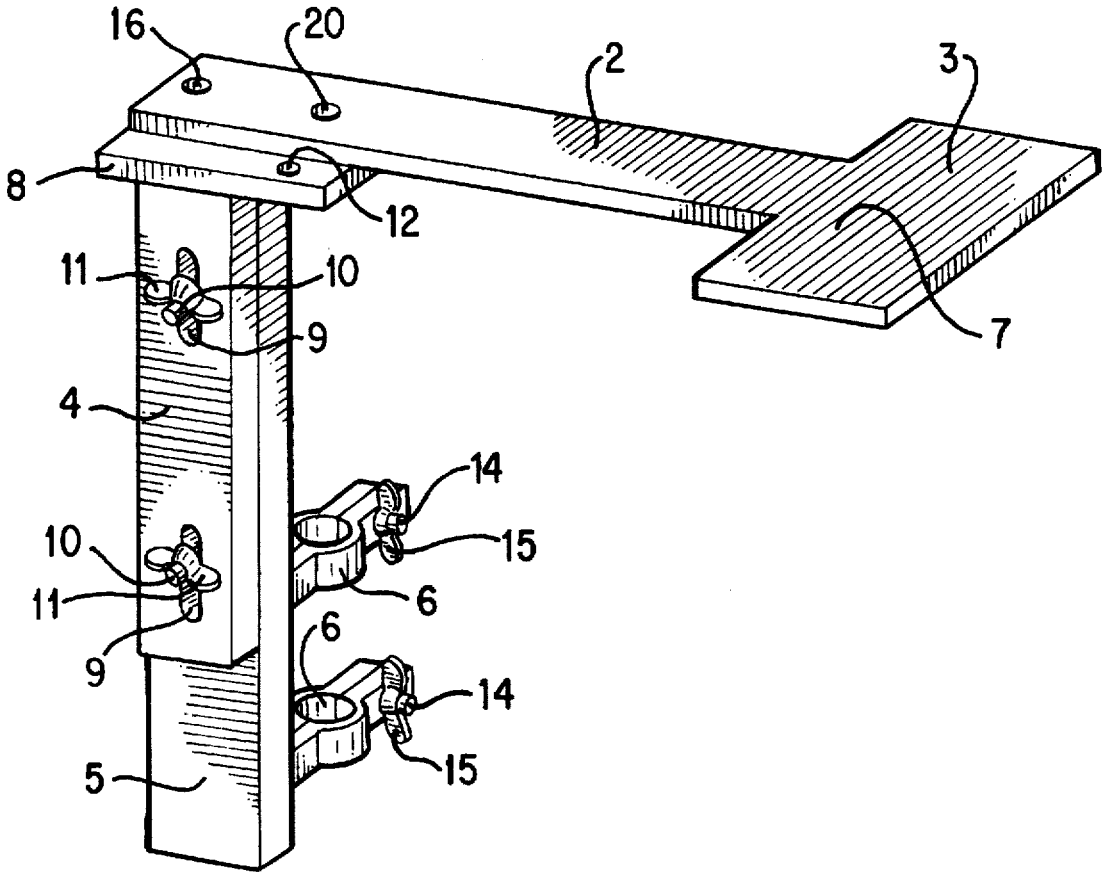
FIG. 1 is a perspective view showing the integrated mouse pad and wrist and arm support member, along with the positioning platform and the attaching member.

FIG. 1 shows a mouse pad portion 3 and a support member portion 2 which are formed as an integral, one-piece, metal platform, the top surface of which forms a common plane which is coated with a vinyl material 7 known to be suitable for forming the surface of a mouse pad. The support member provides support for the wrist and arm of the user of a mouse which is typically placed on the mouse pad during operation of a computer. A means for attaching the integrated mouse pad and wrist and arm support to a chair is provided in the form of a two-piece metal attaching means comprising a first attaching member 4 and a second attaching member 5. The first attaching member 4 is welded, at its top end, to a positioning platform 8 which mates with the support member portion at the end which is opposite to the end which forms the mouse pad. (The mating of the support member portion with the positioning platform will be described below.) The first attaching member 4 extends downward from the position platform and is attached to a second attaching member 5, the first and second attaching member being attached by means of two adjustable connections. These adjustable connections are provided in the form of four vertical slots 9, two of which are milled through each of the first and second attaching members, with bolts 10 passed through the first and second attaching members, and the vertical position of the bolt secured in the slot by wing nuts 11. By means of the vertical slots, the bolts, and the wing nuts the height of the attaching members is made adjustable.

Figure 4:
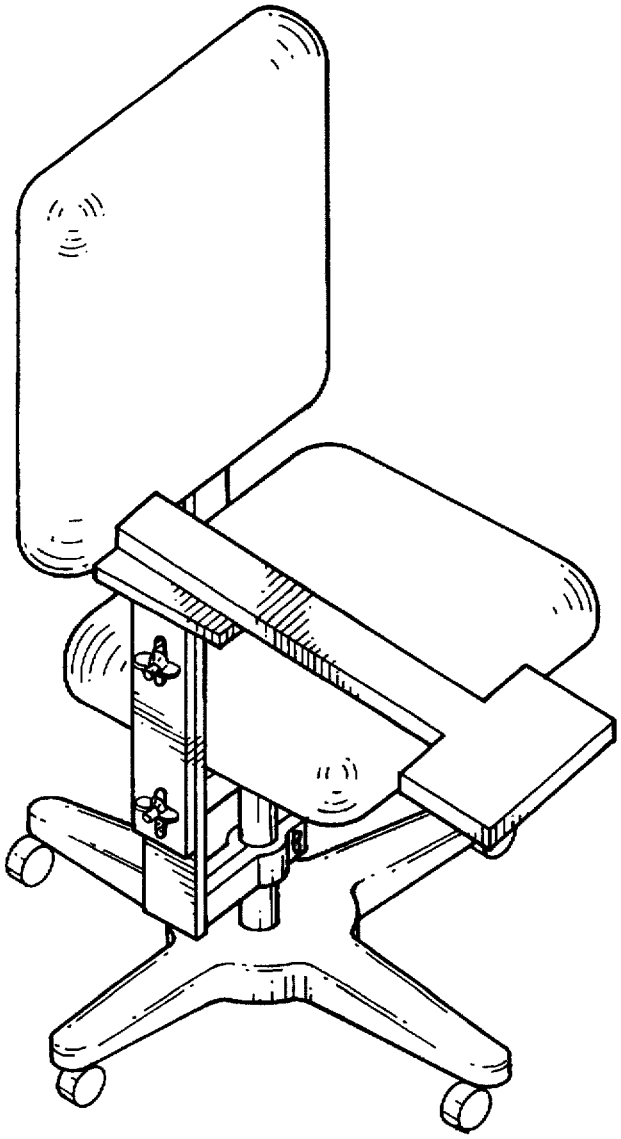
FIG. 4 is a perspective view showing the integrated mouse pad and wrist and arm support attached to an armless chair.

Two clamps 6 are welded to the second attaching member 5 as shown in FIG. 1 and are used to attach the entire assembly to the center column of a chair (See FIG. 4). Each clamp has an open end which can be spread apart to allow the chair's center column to slide into the center of the clamp. A bolt 14 with an associated wing nut 15 is then used to tighten to clamp around the center column of the chair.

Figure 2:
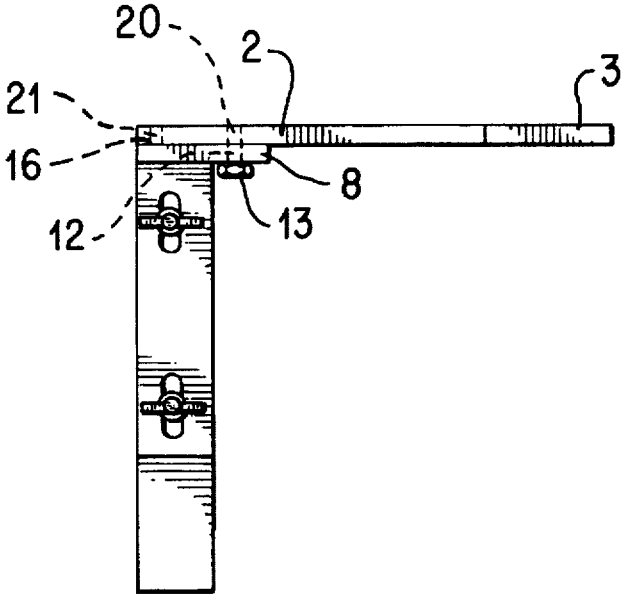
FIG. 2 is a side view showing the relationship between the support member portion, the positioning platform, and the attaching member.
Figure 3:
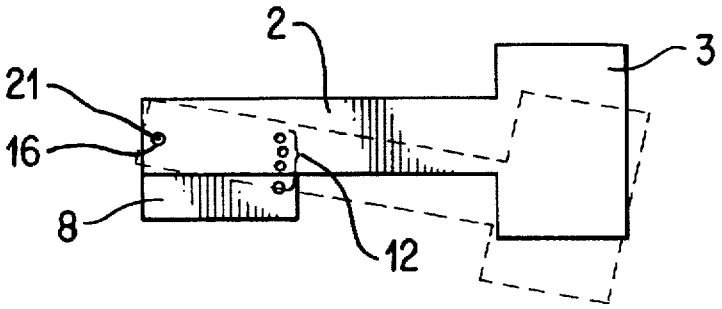
FIG. 3 is a top view showing adjustable positioning of the mouse pad and integrated wrist and arm support.

A seen in FIGS. 1, 2, and 3, the angular position of the support member relative to the user is made adjustable to a selected ergonomic position by means of a positioning platform 8, positioning pin 21, positioning hole 16, three position adjustment holes 12, locking hole 20, and threaded locking bolt 13 (see FIGS. 2 & 3). The positioning platform 8 is a flat metal piece with positioning pin 21 extending upward from the top surface and used to mate with positioning hole 16 in the support member portion 3. The three position adjustment holes 12 are drilled through the positioning platform 8 and internally threaded. The positioning platform 8 is welded to the top of the first attaching member 4. Locking hole 20 is drilled through the support member 3 and internally threaded.

The support member 3 is positioned for use by mating the support member 3 with the positioning platform 8 such that the positioning pin 21 of the positioning platform 8 fits into the positioning hole 16 of the support member portion 3. The support member portion 3 is then swiveled around the positioning pin 21 until its locking hole 20 lines up with one of the three position adjustment holes 12 in the positioning platform 8. A threaded locking bolt 13 is then screwed into the selected positioning hole from the bottom side of the positioning platform. The threads of the threaded locking bolt 13, the internal threads of the three position adjustment holes 12, and the internal threads of the locking hole 20 are made to be compatible, and the length of the threaded locking bolt 13 is sufficient to pass through the positioning platform 8 and engage the locking hole 20 of the support member portion 3. Tightening the locking bolt 13 secures the angular position of the support member 3.

FIG. 4 shows the integrated mouse pad and wrist and arm support assembly attached to a chair and ready for use.

What is claimed is:

1. An integrated mouse pad and wrist and arm support with positioning and attaching assemblies, comprising;

a flat, one-piece, elongated metal member having first and second ends, the shape of said metal member being that of an elongated rectangle except at the first end, said first end being shaped to be larger in size than said second end, said first end being configured in the shape of a computer mouse pad and comprising a mouse pad portion of said flat, one-piece, elongated metal member, the remainder of said flat, one-piece, elongated metal member comprising a wrist and arm support portion;

a positioning assembly comprising a positioning platform, a positioning pin extending upward from said positioning platform, a positioning hole located in said wrist and arm support portion, a plurality of threaded positioning holes located in said positioning platform, a locking hole located in said wrist and arm support portion, and a threaded locking bolt, said positioning pin configured to mate with said positioning hole, said threaded locking bolt configured to mate with said threaded positioning holes and said locking hole, said positioning assembly thus permitting an angular positional adjustment of said wrist and arm support portion;

and an attaching assembly for attaching said integrated mouse pad and wrist and arm support to a chair, said attaching assembly comprising first and second vertical attaching members, said first attaching member having an upper end permanently attached to said positioning platform, and two clamping means permanently attached to said second attaching member, said clamping means being capable of a detachable attachment to a chair's support column, said first and second attaching members being slidably attached to each other.

* * * * *